US010527067B2

(12) United States Patent
Taguchi

(10) Patent No.: US 10,527,067 B2
(45) Date of Patent: Jan. 7, 2020

(54) CYLINDER ACCELERATION MECHANISM

(71) Applicant: TAGUCHI INDUSTRIAL CO., LTD., Okayama (JP)

(72) Inventor: Yuichi Taguchi, Okayama (JP)

(73) Assignee: TAGUCHI INDUSTRIAL CO., LTD., Okayama (JP)

( * ) Notice: Subject to any disclaimer, the term of this patent is extended or adjusted under 35 U.S.C. 154(b) by 150 days.

(21) Appl. No.: 15/760,766

(22) PCT Filed: Jan. 21, 2016

(86) PCT No.: PCT/JP2016/051701
§ 371 (c)(1),
(2) Date: Mar. 16, 2018

(87) PCT Pub. No.: WO2017/047108
PCT Pub. Date: Mar. 23, 2017

(65) Prior Publication Data

US 2018/0258962 A1 Sep. 13, 2018

(30) Foreign Application Priority Data

Sep. 18, 2015 (JP) ..... 2015-184865

(51) Int. Cl.
*F15B 11/04* (2006.01)
*B02C 1/02* (2006.01)
(Continued)

(52) U.S. Cl.
CPC ..... *F15B 11/04* (2013.01); *B02C 1/02* (2013.01); *F15B 9/10* (2013.01); *F15B 11/22* (2013.01);
(Continued)

(58) Field of Classification Search
CPC .. F15B 11/04; F15B 11/22; B02C 1/02; E02F 3/965; E02F 9/2203
(Continued)

(56) References Cited

U.S. PATENT DOCUMENTS

2015/0033723 A1 2/2015 Taguchi

FOREIGN PATENT DOCUMENTS

| | | | |
|---|---|---|---|
| JP | 2006-347709 | A | 12/2006 |
| JP | 2011-38627 | A | 2/2011 |
| WO | 2013114556 | A1 | 8/2013 |

OTHER PUBLICATIONS

International Search Report and Written Opinion for PCT/JP2016/051701 dated (Apr. 26, 2016).

*Primary Examiner* — Michael Leslie
*Assistant Examiner* — Daniel S Collins
(74) *Attorney, Agent, or Firm* — Pearne & Gordon LLP

(57) ABSTRACT

A cylinder acceleration mechanism includes a buffer tank that supplies and discharges oil to and from a bottom-side line that is connected to a bottom-side chamber of an actuating cylinder, and an inversion lever having an intermediate fulcrum as a rotation axis. The buffer tank includes a buffer chamber with a variable capacity achieved by a seal lid moving back and forth inside of a case, and extends and reduces a length of a coupling rod provided to the seal lid and projects from the case. A bottom-side branching line branched from the bottom-side line is connected to the buffer chamber. The actuating rod of the actuating cylinder and the coupling rod of the buffer tank are coupled to respective ends of the inversion lever. The actuating rod and the coupling rod extend and retract alternately with respect to each other as the inversion lever turns.

3 Claims, 6 Drawing Sheets

(51) Int. Cl.
*F15B 9/10* (2006.01)
*F15B 11/22* (2006.01)

(52) U.S. Cl.
CPC ..... *F15B 2211/7053* (2013.01); *F15B 2211/7128* (2013.01)

(58) Field of Classification Search
USPC ..... 91/508
See application file for complete search history.

CYLINDER ACCELERATION MECHANISM

FIELD

The present invention relates to a cylinder acceleration mechanism for an actuating cylinder that extends and reduces the length by which an actuating rod projects from a tube.

BACKGROUND

A shearer attachment closes its jaw by extending an actuating rod of an actuating cylinder (hydraulic cylinder), and opens the jaw by retracting the actuating rod. Because the operation of extending the actuating rod generates a strong force, the extending operation is suitable for crushing work in which the jaw is closed to nip an object to be crushed. Such a shearer attachment has an acceleration circuit for increasing the moving speed of the actuating rod, and reduces the working hours required in crushing by accelerating the operation of extending the actuating rod while no load is applied thereto (with no object to be crushed nipped in the jaw). The operation of retracting the actuating rod is used to open the jaw, which does not require a strong force.

Patent Literature 1 discloses an acceleration circuit for accelerating the operations of extending and retracting the actuating rod. The acceleration circuit disclosed in the Patent Literature 1 is provided with an inversion cylinder, separately from the actuating cylinder for opening and closing the jaw, for example (claim 1, Patent Literature 1), and the inversion cylinder and a bottom-side upstream switching valve are used to switch between a mode for prioritizing the flowrate and that for prioritizing thrust. When the actuating rod is to be extended, the acceleration circuit disclosed in Patent Literature 1 increases the flowrate of the oil to be supplied into the bottom-side chamber of the actuating cylinder. When the actuating rod is to be retracted, the acceleration circuit reduces the flowrate of the oil discharged from the bottom-side chamber of the actuating cylinder. By reducing a loss in the pressure, and increasing the flowrate of the oil sent out from the pump in the manner described above, the speed at which the actuating rod is extended and retracted is increased ([0010], Patent Literature 1).

CITATION LIST

Patent Literature

Patent Literature 1: Japanese Patent Application Laid-open No. 2011-038627

SUMMARY

Technical Problem

To retract the actuating rod, the acceleration circuit disclosed in Patent Literature 1 causes the oil to flow in the manner described below. The oil supplied from the pump in a hydraulic unit is sent into a rod-side chamber via a rod-side line, a rod-side switching valve, and a rod-side base line. In this manner, the oil discharged from the bottom-side chamber of the actuating cylinder is sent into the bottom-side chamber of the inversion cylinder via a bottom-side downstream base line, a bottom-side downstream switching valve, and a bottom-side downstream line. The oil discharged from the rod-side chamber of the inversion cylinder is returned to the tank in the hydraulic unit via a bottom-side upstream base line, a bottom-side upstream switching valve, and a bottom-side line ([0014], Patent Literature 1).

To retract the actuating rod (FIG. 3, Patent Literature 1) having been extended with no load applied thereto (FIG. 1, Patent Literature 1), only required is to change the direction of the oil flow, without switching the switching valves. To retract the actuating rod (FIG. 3, Patent Literature 1) having been extended with a load applied thereto (FIG. 2, Patent Literature 1), the switching valves having been switched are returned to the original positions, before causing the oil to flow. Due to effects such as the presence of check valves for restricting the direction of the oil flow, the switching valves are switched at different timing, and a slight synchronization error is introduced between the actuating cylinder and the inversion cylinder in the operations of extending the actuating rod.

If an error is introduced to the synchronization of the actuating cylinder and the inversion cylinder, there might be cases in which the piston of the actuating cylinder is still on the way to a starting end on the bottom side or a terminating end on the rod side, although the piston of the inversion cylinder has already reached the starting end on the bottom side or the terminating end on the rod side, for example. Such a synchronization error has led to problems such as the acceleration circuit failing to accelerate the extension or the retraction of the actuating rod, or the inversion cylinder restricting the extension and the retraction of the actuating rod. To solve such problems coming up with a synchronization error introduced to an acceleration circuit using a combination of an actuating cylinder paired with an inversion cylinder, the inventors of the present invention have conducted a research on useful means for accelerating the retraction of the actuating rod.

Solution to Problem

The research has resulted in a development of a cylinder acceleration mechanism for an actuating cylinder including a bottom-side chamber and a rod-side chamber each of which has a variable capacity achieved by a piston moving back and forth inside of a tube, a length by which an actuating rod provided to the piston projects from the tube being increased and decreased. The cylinder acceleration mechanism includes a buffer tank that supplies and discharges oil to and from a bottom-side line that is connected to the bottom-side chamber of the actuating cylinder, and an inversion lever having an intermediate fulcrum as an rotation axis. The buffer tank includes a buffer chamber with a variable capacity achieved by a seal lid moving back and forth inside of a case, and is configured to extend and to reduce a length by which a coupling rod provided to the seal lid projects from the case. A bottom-side branching line that is branched from the bottom-side line is connected to the buffer chamber. The actuating rod of the actuating cylinder and the coupling rod of the buffer tank are coupled to respective ends of the inversion lever. The actuating rod and the coupling rod extend and retract alternately with respect to each other in an inverted manner as the inversion lever turns.

The actuating cylinder used in the present invention is a double acting hydraulic cylinder. When the actuating cylinder is a hydraulic cylinder, the buffer chamber of the buffer tank stores therein oil. When the actuating cylinder is an air cylinder, the buffer chamber of the buffer tank stores therein compressed air. The buffer tank may have a structure specialized for the present invention, or an auxiliary cylinder including an open rod-side chamber may be used, as long as the structure includes a buffer chamber with a variable capacity achieved by a seal lid moving back and forth inside of a case, and is configured to extend and to reduce the length by which a coupling rod provided to the seal lid projects from the case. The cylinder acceleration mechanism according to the present invention basically has a structure in which one buffer tank is provided for one actuating cylinder, but it is also possible for one buffer tank to be shared among a plurality of actuating cylinders.

In the operation of extending the actuating rod, a part of the oil discharged from the bottom-side chamber via the bottom-side line passes through the bottom-side branching line that is branched from the bottom-side line, and stored in the buffer chamber of the buffer tank. In this manner, the oil can be discharged smoothly from the bottom-side chamber, and the amount of oil returned to the tank from the bottom-side chamber via the bottom-side line can be reduced. Therefore, the resultant pressure loss is reduced. When the pressure loss is reduced in this manner described above, the pressure of the oil sent into the rod-side chamber via the rod-side line is also reduced. In this manner, the amount of oil to be supplied into the rod-side chamber can be increased by the pump characteristics.

The actuating cylinder causes the actuating rod to retract by receiving an oil supply into the rod-side chamber. The retracting actuating rod causes the inversion lever to turn, to cause the coupling rod of the buffer tank to extend. The seal lid of the buffer tank is then caused to move forward, so that the space inside of the buffer chamber is increased. As a result, the buffer chamber draws in a part of the oil discharged from the bottom-side chamber, and stores therein the oil. A retraction of the actuating rod is thus accelerated, by allowing the oil to be discharged smoothly from the bottom-side chamber, and increasing the amount of oil to be sent into the rod-side chamber, in the manner described above.

The actuating cylinder causes the actuating rod to extend by receiving an oil supply into the bottom-side chamber via the bottom-side line. The extending actuating rod causes the inversion lever to turn, to cause the coupling rod of the buffer tank to retract. In this manner, the oil stored in the buffer chamber is returned to the bottom-side line, merged with the oil being supplied via the bottom-side line, and is supplied into the bottom-side chamber. The extension of the actuating rod is thus accelerated, by allowing the oil discharged from the buffer tank to merge with the oil to be supplied, and by allowing a larger amount of oil to be supplied into the bottom-side chamber.

The cylinder acceleration mechanism according to the present invention is additionally provided with a switching valve for switching the oil flow between those with and without a load applied to the actuating rod while the actuating rod is extended. The buffer tank has a connection switched by the switching valve to connect to one of a rod-side branching line branched from the rod-side line that is connected to the rod-side chamber of the actuating cylinder, and the bottom-side branching line. The switching valve has a discharging port section that connects a tank-side line extending from the buffer chamber of the buffer tank to the bottom-side branching line, and a supply port section that connects the tank-side line to the rod-side branching line, and normally activates the discharging port section. A bottom-side pilot line for switching the discharging port section to the supply port section is extended from the bottom-side line or the bottom-side branching line.

As the switching valve, a three-port two-position switching valve in which one of two input-side ports is connected to an output-side port is preferable. A four-port two-position switching valve, a three-port or four-port three-position switching valve, or the like may also be used, as long as the connection of the tank-side line to the bottom-side branching line or the rod-side branching line can be switched. Being "normally switched to the discharging port section" means that the switching valve is switched to the side of the discharging port section using a biasing unit, for example, in such a manner that the bottom-side branching line is connected to the tank-side line. When the oil pressure is applied to the bottom-side pilot line, the switching valve is switched to the supply port section, against the biasing unit or the like, and the rod-side branching line becomes connected to the tank-side line.

While the actuating rod is being retracted, by allowing the buffer chamber of the buffer tank to store therein a part of the oil that is discharged from the bottom-side chamber via the bottom-side line, the oil is discharged smoothly from the bottom-side chamber. Furthermore, by reducing the amount of oil returned from the bottom-side chamber into the tank, the amount of oil supply sent into the rod-side chamber is increased. A retraction of the actuating rod is thus accelerated, by allowing the oil to be discharged smoothly from the bottom-side chamber, and increasing the amount of oil to be sent into the rod-side chamber, in the same manner as described above.

The actuating cylinder causes the actuating rod to extend by receiving an oil supply into the bottom-side chamber via the bottom-side line. At this time, when the extending actuating rod has no load applied thereto, the actuating rod causes the inversion lever to turn, causing the coupling rod of the buffer tank to retract thereby. In this manner, the oil stored in the buffer chamber is supplied into the bottom-side chamber via the bottom-side line, so that the extension of the actuating rod is accelerated.

By contrast, when the extending actuating rod has some load applied thereto, the oil pressure increases in the bottom-side line, and switches the switching valve to the supply port section via the bottom-side pilot line. In this manner, the oil is supplied into the bottom-side chamber of the actuating cylinder via the bottom-side line, and is returned from the rod-side chamber to the tank via the rod-side line, as normally is. Furthermore, the oil in the buffer chamber is returned to the tank via the tank-side line, the supply port section, and the rod-side branching line. In this manner, the actuating rod can be extended against the load, because the rotation of the inversion lever is not obstructed by the buffer tank.

Advantageous Effects of Invention

The cylinder acceleration mechanism according to the present invention does not exhibit the problem resultant of a synchronization error introduced in the acceleration circuit that uses a combination of an actuating cylinder paired with an inversion cylinder. This is an effect achieved by causing the actuating rod of the actuating cylinder and the coupling rod of the buffer tank to extend and retract alternately with respect to each other via a mechanical operation that is a turn of the inversion lever, instead of causing the actuating cylinder to operate in conjunction with the inversion cylinder via switching of the switching valves.

Furthermore, because the cylinder acceleration mechanism according to the present invention is additionally provided with the switching valve, the cylinder acceleration mechanism can accelerate the extension of the actuating rod while no load is applied thereto, and ensure the force for pushing the actuating rod when a load is applied thereto, in the operation of extending the actuating rod. These are effects achieved because the oil pushed out of the buffer tank is merged with the oil from the tank, and helps the extension of the actuating rod with no load applied, and because the oil pushed out of the buffer tank is returned to the tank so that the extension of the actuating rod is not obstructed with a load applied.

In addition, the cylinder acceleration mechanism according to the present invention can be simplified and reduced in size, advantageously. The buffer tank only requires a buffer capacity slightly exceeding the maximum capacity difference between the bottom-side chamber and the rod-side chamber of the actuating cylinder, therefore, a small auxiliary cylinder may be used as the buffer tank. The inversion lever may also have some bent part in a middle, as long as alternating extensions and retractions of the actuating rod and the coupling rod can be achieved. Therefore, the inversion lever can be easily designed to suit for the attachment. Based on the above, the cylinder acceleration mechanism according to the present invention can be applied to various attachments that use an actuating cylinder.

DESCRIPTION OF EMBODIMENTS

Figure 1:
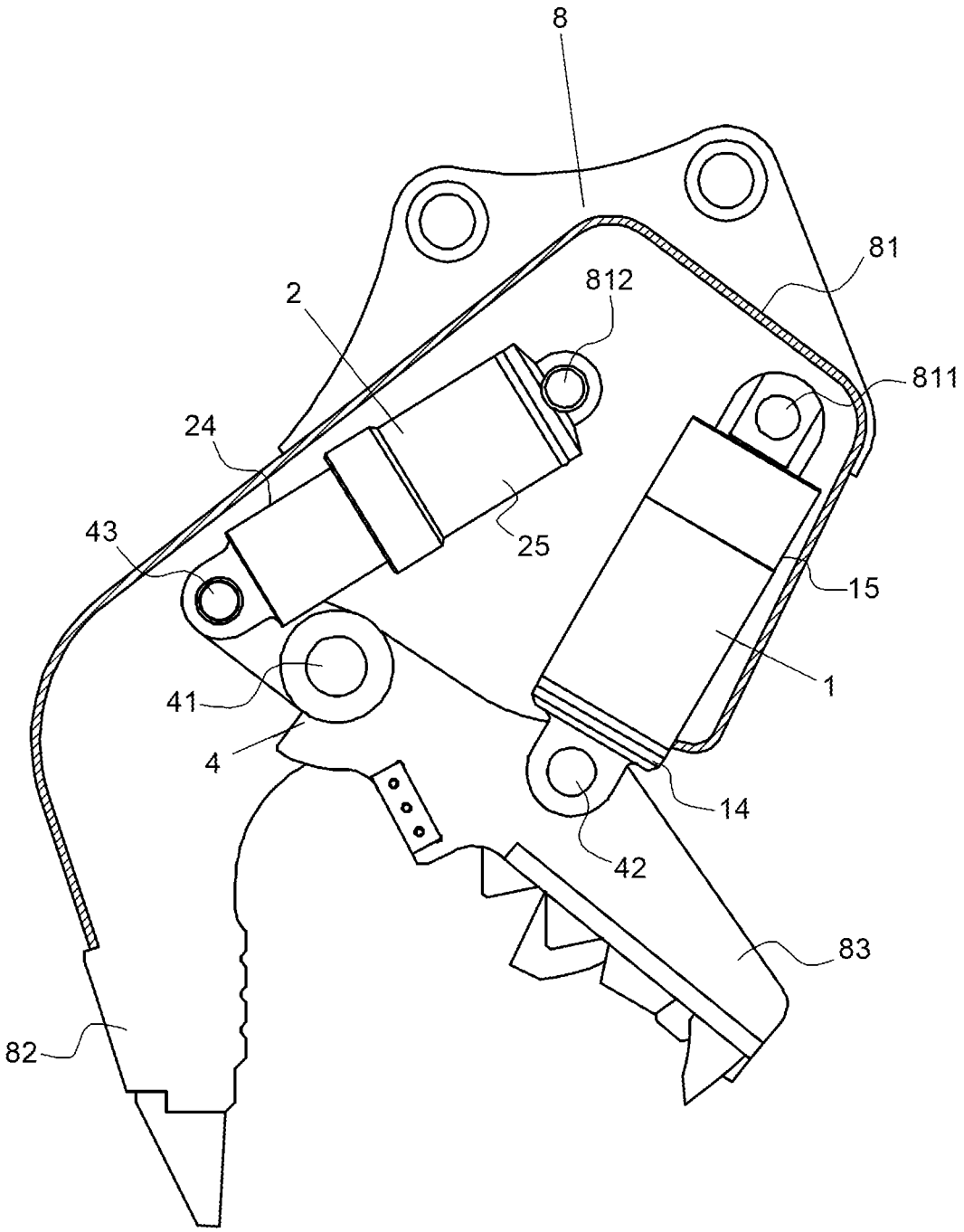
FIG. 1 is a breakaway view of an example of a shearer attachment according to the present invention.

One embodiment for implementing the present invention will now be explained with reference to some drawing. The cylinder acceleration mechanism according to the present invention is used in a shearer attachment 8 having a hydraulic cylinder as an actuating cylinder 1, as illustrated in FIG. 1, for example. The shearer attachment 8 according to this example includes a fixed jaw 82 that is integrated with a main body frame 81, and a movable jaw 83 that is pivotally attached to the main body frame 81, and that opens and closes with respect to the fixed jaw 82. In FIG. 1, elements such as a bottom-side line 6, a bottom-side branching line 61, a bottom-side pilot line 62, a rod-side line 7, a rod-side branching line 71, a rod-side pilot line 72, and a switching valve 3 that are connected to the actuating cylinder 1 and to a buffer tank 2 are not illustrated, for the convenience of illustration in the drawing.

The movable jaw 83 according to this example has a portion that is pivotally attached to the main body frame 81 as a fulcrum 41, and an actuating rod 14 of the actuating cylinder 1 is pivotally attached to the movable jaw 83 at an actuating rod pivotally attached point 42 that is provided on one side (lower right side in FIG. 1) of the movable jaw 83 facing the fixed jaw 82, being one side with respect to the fulcrum 41. A coupling rod 24 of the buffer tank 2 is also pivotally attached to the movable jaw 83 at a coupling rod pivotally attached point 43 that is provided to an extended part of the movable jaw 83, being extended toward the other side (upper left side in FIG. 1) with respect to the fulcrum 41. The portion extending between the actuating rod pivotally attached point 42 and the coupling rod pivotally attached point 43, with the fulcrum 41 interposed therebetween, is used as an inversion lever 4. The inversion lever 4 is a rotating lever that inverts extension and retraction of the actuating rod 14 and the coupling rod 24 alternately with respect to each other.

The actuating cylinder 1 and the buffer tank 2 are both housed in the main body frame 81. In the actuating cylinder 1 according to this example, a bottom-side end (the upper end in FIG. 1) of a tube 15 is pivotally attached to a cylinder pivotally attached point 811, in a manner enabled to rotate with respect to the main body frame 81, and the actuating rod 14 projecting from the tube 15 is pivotally attached to an actuating rod pivotally attached point 42, in a manner enabled to rotate with respect to the movable jaw 83. In this manner, the actuating cylinder 1 enables the actuating rod 14 to be extended and retracted smoothly, by changing the orientation thereof as the movable jaw 83 rotates.

The buffer tank 2 according to this example is provided as an auxiliary cylinder (hydraulic cylinder) having a bottom-side chamber thereof serving as a buffer chamber 21, a tube thereof serving as a case 25, a piston thereof serving as a seal lid 23, and a rod thereof serving as the coupling rod 24. In the buffer tank 2 according to this example, the bottom-side end of the case 25 (the upper right end in FIG. 1) is pivotally attached to a buffer pivotally attached point 812 in a manner enabled to rotate with respect to the main body frame 81, and the coupling rod 24 projecting from the case 25 is pivotally attached to a coupling rod pivotally attached point 43, in a manner enabled to rotate with respect to the extended portion of the movable jaw 83. In this manner, the buffer tank 2 enables the coupling rod 24 to be extended and retracted smoothly, by changing the orientation thereof as the movable jaw 83 rotates.

Figure 2:
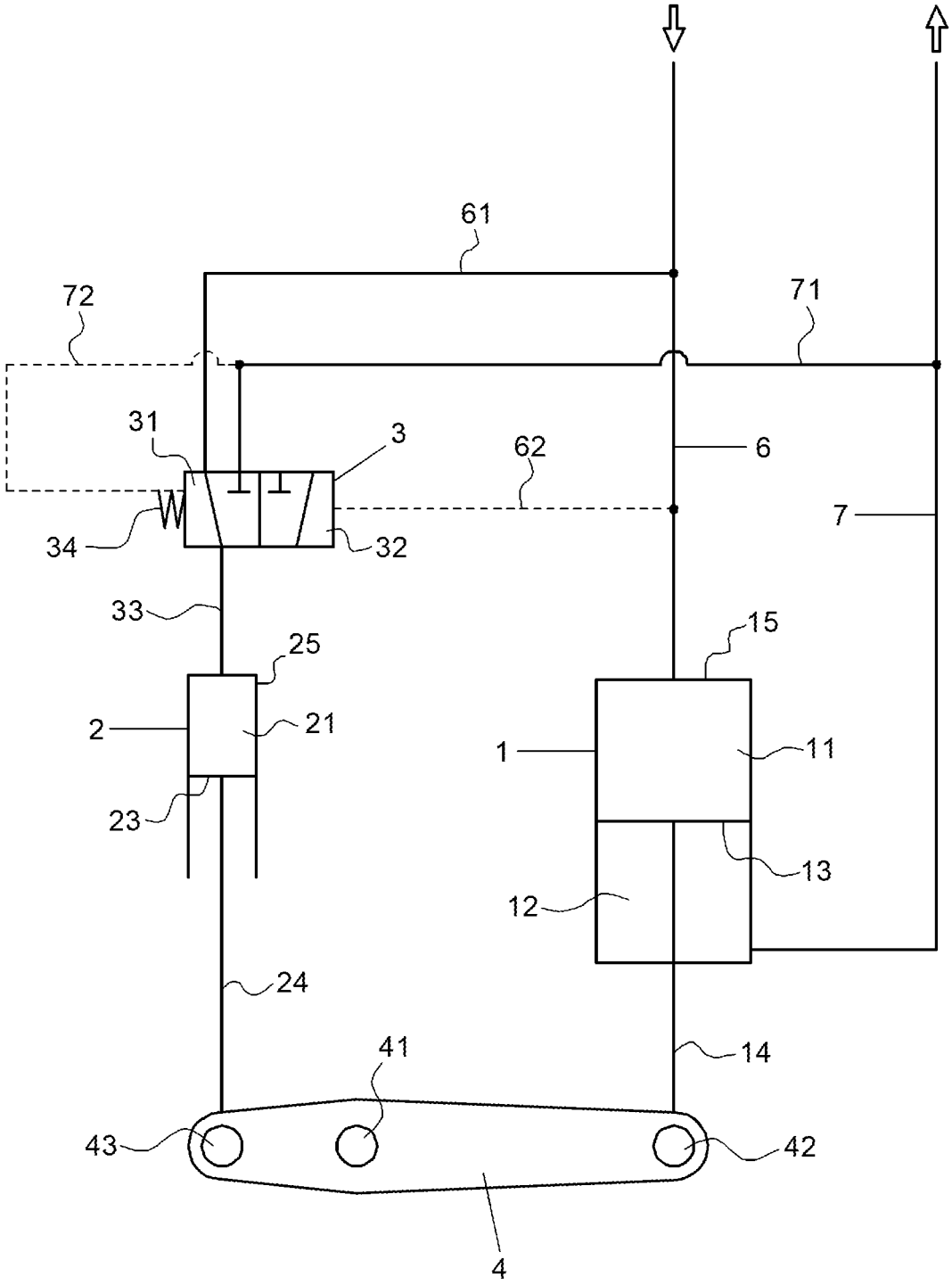
FIG. 2 is a hydraulic circuit illustrating a cylinder acceleration mechanism according to the example.

The cylinder acceleration mechanism according to this example is provided as a combination of the hydraulic circuit and the inversion lever 4 illustrated in FIG. 2, for example. The actuating cylinder 1 has a bottom-side chamber 11 and a rod-side chamber 12 each of which has a variable capacity achieved by a columnar piston 13 moving back and forth inside of the cylindrical tube 15, and extends and reduces the length by which the actuating rod 14 extending perpendicularly to the surface of the piston 13 from the center of the piston 13 projects from the tube 15. A bottom-side line 6 that extends from a pump (not illustrated) is connected to the bottom-side chamber 11. A rod-side line 7 that extends from the tank is connected to the rod-side chamber 12.

A conventional shearer attachment 8 only has the actuating cylinder 1, the bottom-side line 6, and the rod-side line 7. The cylinder acceleration mechanism according to the present invention includes the buffer tank 2, the switching valve 3, and the inversion lever 4, in addition to the actuating cylinder 1, the bottom-side line 6, and the rod-side line 7. The switching valve 3 is configured to select one of a bottom-side branching line 61 that is branched from the bottom-side line 6, and a rod-side line 71 that is branched from and the rod-side line 7, and to connect the selected one to a tank-side line 33 that is connected to the buffer tank 2.

The buffer tank 2 includes a buffer chamber 21 with a variable capacity achieved by a columnar seal lid 23 moving back and forth inside of the cylindrical case 25, and extends and reduces the length by which the coupling rod 24 extending perpendicularly to the surface of the seal lid 23 from the center of the seal lid 23 projects from the case 25. As mentioned earlier, the buffer tank 2 according to this example is provided as an auxiliary cylinder that is a hydraulic cylinder, and has a structure in which the hydraulic cylinder includes an open rod-side chamber. In the open rod-side chamber, the rod-side end through which the coupling rod 24 is passed may be removed, or may be kept as it is to support the coupling rod 24.

The cylinder acceleration mechanism according to this example has the switching valve 3 for switching between the bottom-side branching line 61 and the rod-side line 71 to be selectively connected to the buffer tank 2. The switching valve 3 has a discharge-side port section 31 for connecting the tank-side line 33 that extends from the buffer chamber 21 of the buffer tank 2 to the bottom-side branching line 61, and a supply-side port section 32 for connecting the tank-side line 33 to the rod-side branching line 71. In FIG. 1, the switching valve 3, although not illustrated, is positioned inside of the main body frame 81 as appropriate, in a manner suitable for the bottom-side branching line 61, the rod-side branching line 71, and the tank-side line 33, for example.

The switching valve 3 according to this example is a three-port two-position switching valve having the discharge-side port section 31 and the supply-side port section 32 each section of which has three ports, two of which are for input, and the remaining one is for output. The discharge-side port section 31 connects the bottom-side branching line 61 to the tank-side line 33, but closes the rod-side branching line 71. Reversely, the supply-side port section 32 connects the rod-side branching line 71 to the tank-side line 33, but closes the bottom-side branching line 61. With such a configuration, by switching the switching valve 3, the line to be connected to the buffer chamber 25 of the buffer tank 2 via the tank-side line 33 is switched between the bottom-side branching line 61 or the rod-side branching line 71.

In the switching valve 3 according to this example, the discharge-side port section 31 is normally activated by being pushed by a coil spring 34 biasing the switching valve 3 from the side of the discharge-side port section 31 so that the bottom-side branching line 61 is connected to the tank-side line 33. In the switching valve 3 according to this example, the supply-side port section 32 is activated by being pushed by an oil pressure generated in the bottom-side pilot line 62 that extends from the bottom-side line 6. In the switching valve 3 according to this example, a spring section side line 72 for supplying or discharging oil filled in a spring section (not illustrated) in which the coil spring 34 is housed is connected to the rod-side branching line 71 through the spring section.

Figure 3:
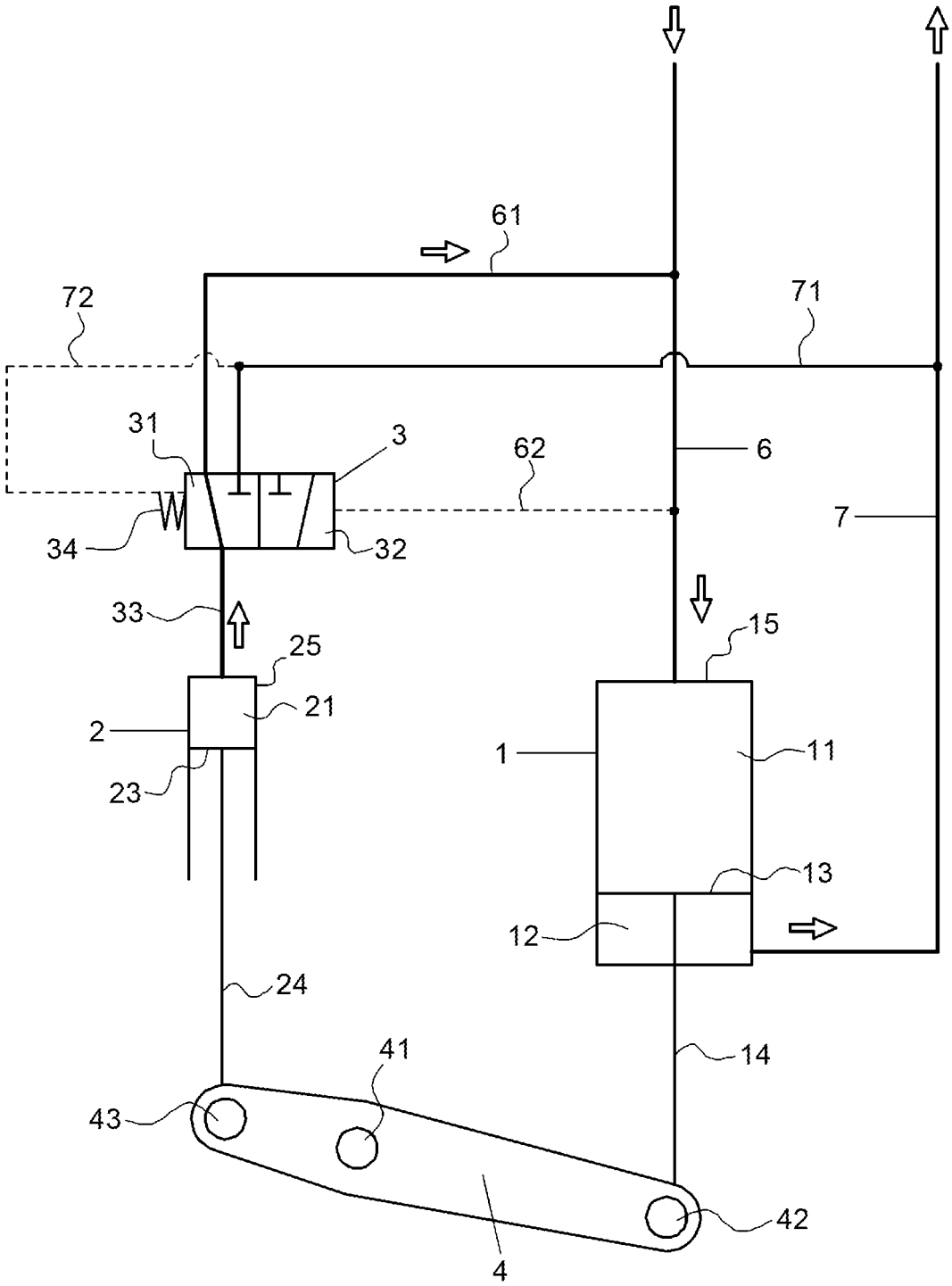
FIG. 3 is a hydraulic circuit illustrating an actuating rod being extended with no load applied.

An operation of the cylinder acceleration mechanism according to this example will now be explained. To close the movable jaw 83 of the shearer attachment 8 (see FIG. 1; the same applies below), the actuating rod 14 of the actuating cylinder 1 is extended by supplying oil into the bottom-side chamber 11 via the bottom-side line 6, and discharging the oil from the rod-side chamber 12 via the rod-side line 7, as illustrated in FIG. 3. At this time, if there is nothing between the fixed jaw 82 and the movable jaw 83, no load is applied to the extending actuating rod 11. Therefore, the pressure of the oil in the bottom-side pilot line 62 remains unincreased, so that the switching valve 3 is not switched. Therefore, the buffer chamber 25 of the buffer tank 2 remains connected to the bottom-side branching line 61. The buffer chamber 25 discharges the oil to the bottom-side line 6 by being compressed, and draws in the oil from the bottom-side line 6 by being expanded.

When the actuating rod 14 is extended and causes the inversion lever 4 to turn, the coupling rod 24 retracted, and the seal lid 23 moves back, and the buffer chamber 21 becomes compressed. In this manner, the oil stored in the buffer chamber 21 is supplied into the bottom-side branching line 61, and into the bottom-side chamber 11 of the actuating cylinder 1 via the bottom-side line 6. This means that the total amount of oil sent into the bottom-side chamber 11 is increased, without increasing the flowrate of the oil sent out from the tank by the pump. In this manner, by increasing the total amount of oil sent into the bottom-side chamber 11, the extension of the actuating rod 14 is accelerated.

Figure 4:
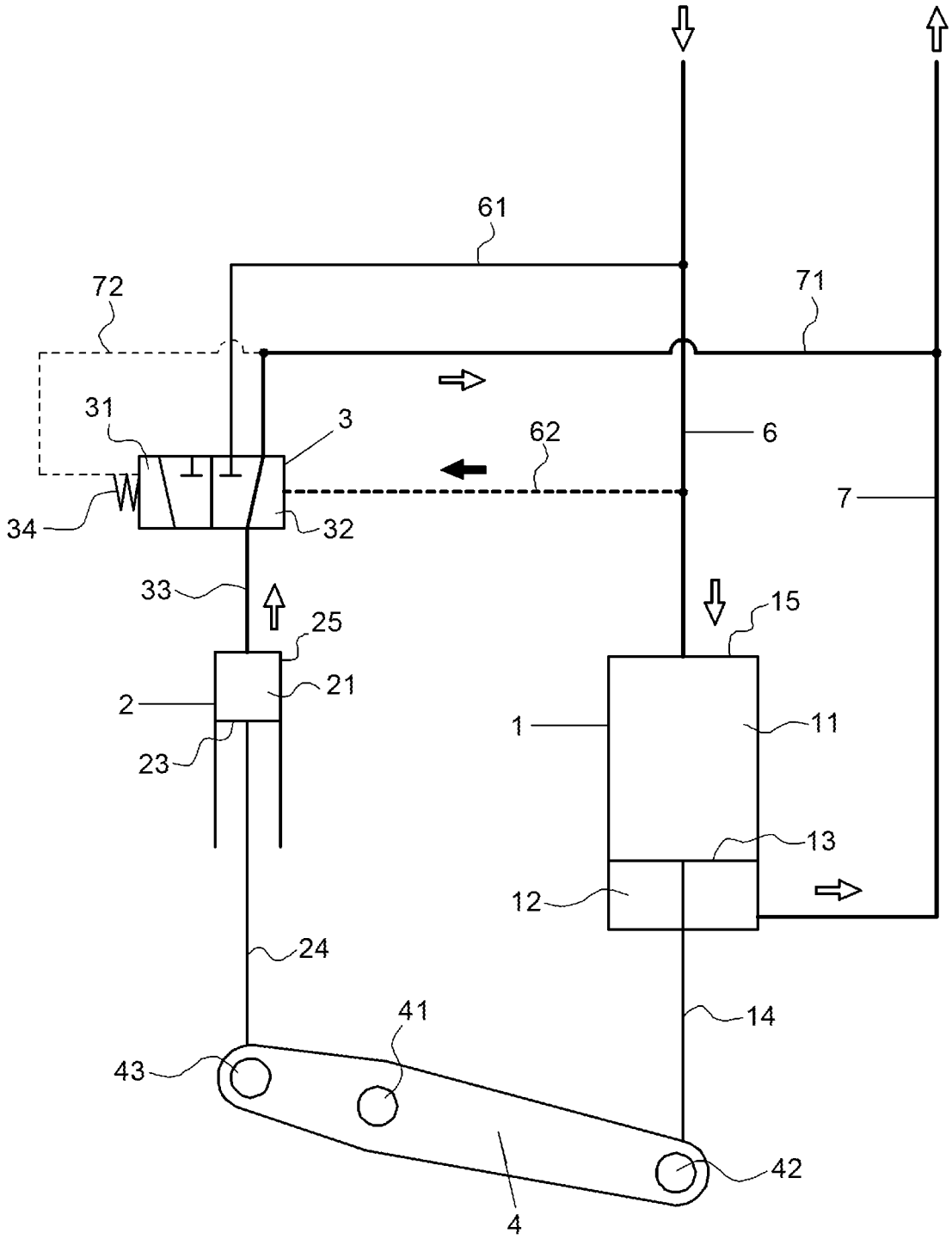
FIG. 4 is a hydraulic circuit illustrating the actuating rod being extended with a load applied.

If the fixed jaw 82 and the movable jaw 83 are to be closed with something nipped therebetween, a load is applied to the extending actuating rod 14, increasing the oil pressure in the bottom-side pilot line 62, and the switching valve 3 is switched, as illustrated in FIG. 4. At this time, a small amount of oil is discharged from the spring section in which the coil spring 34 is housed, into the rod-side branching line 71 via the spring section side line 72. In this manner, the buffer chamber 25 of the buffer tank 2 becomes connected to the rod-side branching line 61. When the buffer chamber 25 becomes compressed, the oil is discharged into the rod-side line 7. When the buffer chamber 25 is expanded, the buffer chamber 25 draws in the oil from the rod-side line 7. Because the fixed jaw 82 and the movable jaw 83 are closed with something nipped therebetween, the switching valve 3 remains switched, until the oil pressure in the bottom-side pilot line 62 drops.

When the actuating rod 14 is extended and causes the inversion lever 4 to turn, the coupling rod 24 is retracted, and the seal lid 23 compresses the buffer chamber 21. This compression causes the oil stored in the buffer chamber 21 to be returned to the tank via the rod-side branching line 71 and the rod-side line 7. This means that the oil stored in the buffer chamber 21 is discharged without any delay so that the rotation of the inversion lever 4 is not obstructed thereby. In this manner, because the extension of the actuating rod 14 is not obstructed by the inversion lever 4, the thrust of the actuating rod 14 is ensured.

Figure 5:
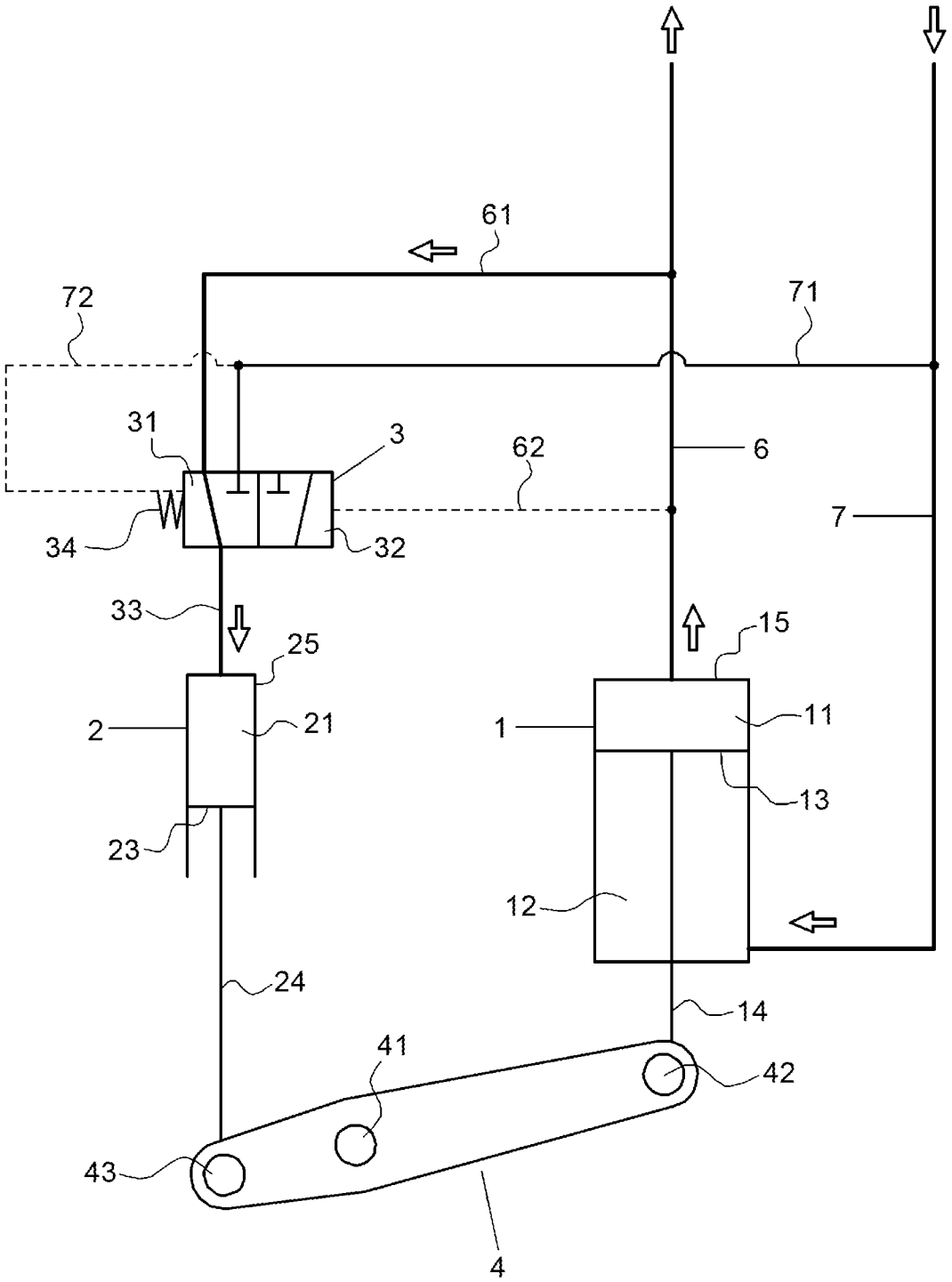
FIG. 5 is a hydraulic circuit illustrating the actuating rod being retracted.

When the shearer attachment 8 opens the movable jaw 83, the oil is supplied into the rod-side chamber 12 via the rod-side line 7, and the oil is discharged from the bottom-side chamber 11 via the bottom-side line 6, as illustrated in FIG. 5, to cause the actuating rod 14 of the actuating cylinder 1 to retract. Because there is nothing between the opening fixed jaw 82 and movable jaw 83, no load is applied to the retracting actuating rod 11. Therefore, the oil pressure in the bottom-side pilot line 62 remains unincreased, and the switching valve 3 remains not switched. If the switching valve 3 has been switched in the extension of the actuating rod 11 (see FIG. 4, for example), the switching valve 3 is pushed back by the coil spring 34, and returned to the original position. In this manner, the buffer chamber 25 of the buffer tank 2 becomes connected to the bottom-side branching line 61.

When the actuating rod 14 retracts and causes the inversion lever 4 to turn, the coupling rod 24 is caused to extend and the seal lid 23 is moved forward, so that the buffer chamber 21 is expanded. In this manner, a part of the oil that is discharged from the bottom-side chamber 11 is pulled into the buffer chamber 21 via the bottom-side line 6 and the bottom-side branching line 61, and stored in the buffer chamber 21. By reducing the amount of oil returned from the bottom-side chamber 11 into the tank, the pressure loss is reduced, and the oil is discharged smoothly from the bottom-side chamber 11. In addition, a larger amount of oil is supplied into the rod-side chamber 12 while the pressure of the oil sent into the rod-side chamber 12 is reduced. Because the oil is discharged smoothly from the bottom-side chamber 11, a larger amount of oil is sent into the rod-side chamber 12, and the further extending coupling rod 24 causes the actuating rod 14 to retract via the inversion lever 4, in the manner described above, the retraction of the actuating rod 14 is accelerated.

Figure 6:
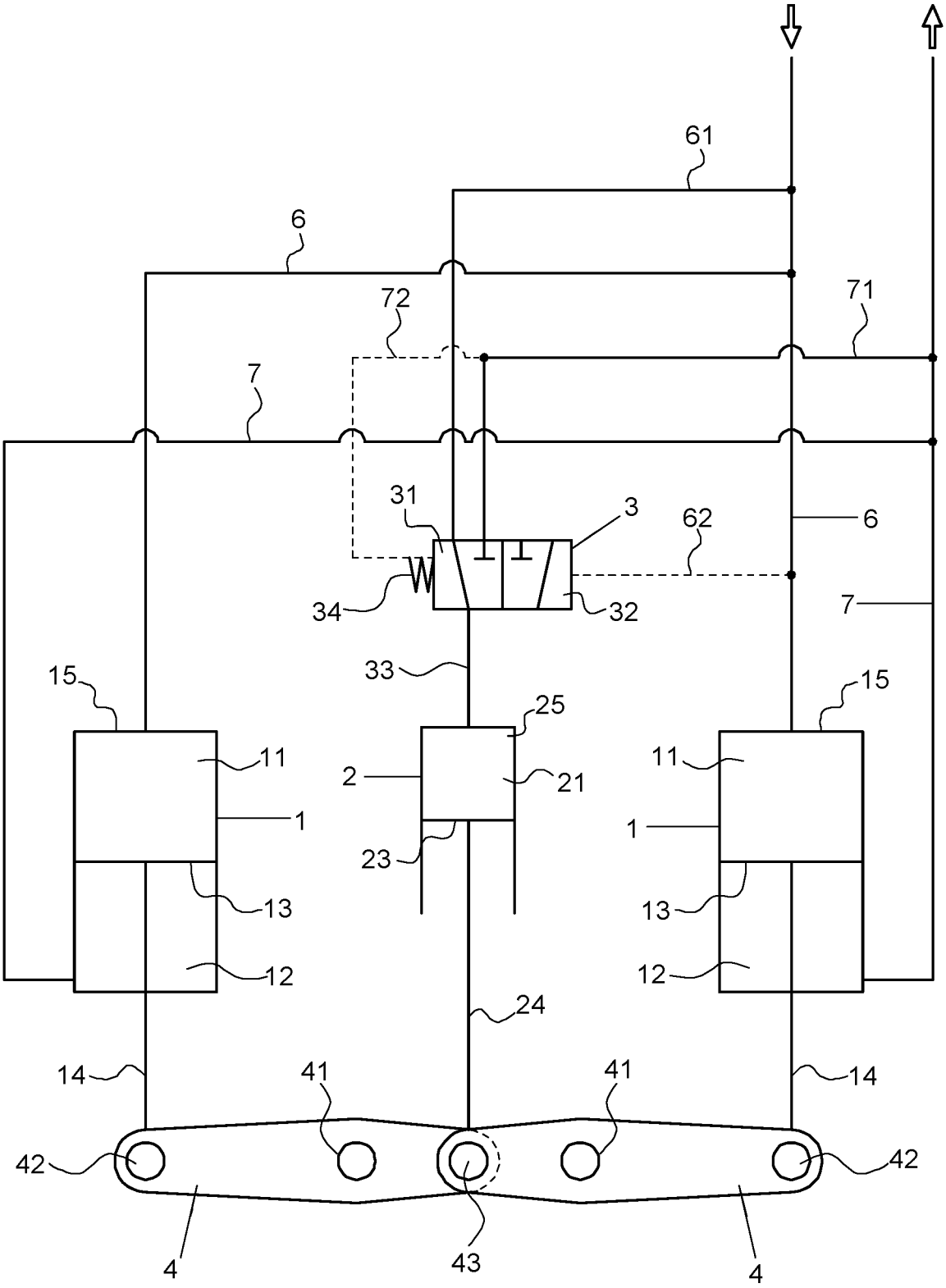
FIG. 6 is a hydraulic circuit illustrating another example of the cylinder acceleration mechanism in which one buffer tank is shared between two actuating cylinders.

When the cylinder acceleration mechanism according to the present invention uses a plurality of actuating cylinders, one buffer tank is basically assigned to each of the actuating cylinders. However, if the numbers of actuating cylinders, the inversion levers, and the buffer tanks are all increased, these components no longer fit inside of the main body frame, and the size of the attachment will be increased. To address this issue, one buffer tank 2 may be shared between two actuating cylinders 1, 1, for example, as illustrated as another example of the cylinder acceleration mechanism in FIG. 6. Because the inversion levers 4, 4 connect the actuating cylinders 1 and the buffer tank 2, two inversion levers 4, 4 are provided in a manner corresponding to the number of the actuating cylinders 1, 1, but the coupling rod pivotally attached point 43 is shared. A structure including a plurality of actuating cylinders 1 is found in a shearer attachment in which both jaws are movable.

In the other example of the cylinder acceleration mechanism, the bottom-side line 6 and the rod-side line 7 are both branched into two lines, and the branches of the bottom-side line 6 are then connected to the bottom-side chambers 11, 11 of the respective actuating cylinders 1, 1, and the branches of the rod-side line 7 are connected to the rod-side chambers 12, 12 of the respective actuating cylinders 1, 1. It is also possible to extend two bottom-side lines 6 and two rod-side lines 7 directly from the tank and the pump of the hydraulic unit, and to connect the bottom-side lines 6 to the bottom-side chambers 11, 11, and connect the rod-side lines 7 to the rod-side chambers 12, 12 of the respective actuating cylinders 1, 1. The bottom-side branching line 61 is connected to the bottom-side line 6 at a position nearer to the tank or the pump with respect to the position where the bottom-side line 6 is branched into two. The rod-side branching line 71 is connected to the rod-side line 7 at a position nearer to the tank or the pump with respect to the position where the rod-side line 7 is branched into two.

In the actuating cylinders 1, 1, the oil is supplied into the bottom-side chambers 11, 11, in the same manner, via the respective bottom-side lines 6, 6, and causes the actuating rods 14, 14 to extend in a synchronized manner. In this manner, the inversion levers 4, 4 turn and cause the coupling rod 24 of the buffer tank 2 to retract in a synchronized manner. The buffer tank 2 supplies the oil stored in the buffer chamber 21 into the bottom-side chambers 11, 11 of the respective actuating cylinders 1, 1 via the respective two branched bottom-side lines 6, 6, and accelerates the extension of the actuating rods 14, 14. When a load is applied to the actuating rods 14 of the respective actuating cylinders 1, the oil pressure in the bottom-side pilot line 62 is increased, causing the switching valve 3 to switch thereby, so that the oil in the buffer chamber 21 is return to the tank. Usually, because the two actuating cylinders 1, 1 act equally on the object, the bottom-side pilot line 62 only needs to monitor one of the actuating cylinders 1.

Furthermore, in the actuating cylinders 1, 1, the oil is supplied into the rod-side chambers 12, 12 via the respective rod-side lines 7, 7 in the same manner, causing the respective actuating rods 14, 14 to retract in a synchronized manner. In this manner, the inversion levers 4, 4 turn and cause the coupling rod 24 of the buffer tank 2 to extend in a synchronized manner. In the buffer tank 2, a part of the oil discharged from the bottom-side chambers 11, 11 of the respective actuating cylinders 1, 1 is then drawn into and stored in the buffer chamber 21, and as a result, retractions of the actuating rods 14, 14 are accelerated. In the other example of the cylinder acceleration mechanism, because the oil is sent into the one buffer tank 2 from the two actuating cylinders 1, 1, the capacity of the buffer chamber 21 is set twice of the example explained above (see FIGS. 1 to 5).

REFERENCE SIGNS LIST

1 actuating cylinder
11 bottom-side chamber
12 rod-side chamber
14 actuating rod
2 buffer tank
21 buffer chamber
24 coupling rod
3 switching valve
31 discharge-side port section
32 supply-side port section
33 tank-side line
4 inversion lever
41 fulcrum
42 actuating rod pivotally attached point
43 coupling rod pivotally attached point
6 bottom-side line
61 bottom-side branching line
62 bottom-side pilot line
7 rod-side line
71 rod-side branching line
72 spring section side line
8 shearer attachment
81 main body frame
82 fixed jaw
83 movable jaw

The invention claimed is:

1. A cylinder acceleration mechanism for an actuating cylinder including a bottom-side chamber and a rod-side chamber each of which has a variable capacity achieved by a piston moving back and forth inside of a tube, a length by which an actuating rod provided to the piston projects from the tube being increased and decreased, the cylinder acceleration mechanism comprising:

a buffer tank that supplies and discharges oil to and from a bottom-side line that is connected to the bottom-side chamber of the actuating cylinder, and an inversion lever having an intermediate fulcrum as a rotation axis, wherein the buffer tank includes a buffer chamber with a variable capacity achieved by a seal lid moving back and forth inside of a case, and is configured to extend and to reduce a length by which a coupling rod provided to the seal lid projects from the case, a bottom-side branching line that is branched from the bottom-side line is connected to the buffer chamber, the actuating rod of the actuating cylinder and the coupling rod of the buffer tank are coupled to respective ends of the inversion lever, and the actuating rod and the coupling rod extend and retract alternately with respect to each other as the inversion lever turns.

2. The cylinder acceleration mechanism according to claim 1, wherein the buffer tank is an auxiliary cylinder including an open rod-side chamber.

3. The cylinder acceleration mechanism according to claim 1, wherein the buffer tank has a connection switched by a switching valve to connect to one of a rod-side branching line branched from the rod-side line that is connected to the rod-side chamber of the actuating cylinder, and the bottom-side branching line, the switching valve has a discharging port section that connects a tank-side line extending from the buffer chamber of the buffer tank to the bottom-side branching line, and a supply port section that connects the tank-side line to the rod-side branching line, and normally activates the discharging port section, and a bottom-side pilot line for switching the discharging port section to the supply port section is extended from the bottom-side line or the bottom-side branching line.

* * * * *